US009916970B2

(12) United States Patent
Morris et al.

(10) Patent No.: US 9,916,970 B2
(45) Date of Patent: Mar. 13, 2018

(54) ION SOURCE

(71) Applicant: Micromass UK Limited, Wilmslow (GB)

(72) Inventors: Michael Raymond Morris, Glossop (GB); Steven Derek Pringle, Darwen (GB); Richard Ellson, Sunnyvale, CA (US); Richard Stearns, Sunnyvale, CA (US); Lars Majlof, Sunnyvale, CA (US); Ian Sinclair, Macclesfield (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/519,286

(22) PCT Filed: Oct. 16, 2015

(86) PCT No.: PCT/GB2015/053091
§ 371 (c)(1),
(2) Date: Apr. 14, 2017

(87) PCT Pub. No.: WO2016/059432
PCT Pub. Date: Apr. 21, 2016

(65) Prior Publication Data

US 2017/0243729 A1 Aug. 24, 2017

(30) Foreign Application Priority Data

Oct. 17, 2014 (GB) ..... 1418511.0
Oct. 20, 2014 (EP) ..... 14189600
Feb. 9, 2015 (GB) ..... 1502111.6

(51) Int. Cl.
*H01J 49/04* (2006.01)
*H01J 49/00* (2006.01)
*H01J 49/10* (2006.01)

(52) U.S. Cl.
CPC ..... *H01J 49/0454* (2013.01); *H01J 49/0031* (2013.01); *H01J 49/105* (2013.01)

(58) Field of Classification Search
USPC ..... 250/288, 423 R, 424
See application file for complete search history.

(56) References Cited

U.S. PATENT DOCUMENTS 6,603,118 B2 8/2003 Elrod et al.
6,827,287 B2 12/2004 Elrod et al.
7,208,727 B2 4/2007 Fedorov et al.
(Continued)

FOREIGN PATENT DOCUMENTS

WO 2011/060369 5/2011

OTHER PUBLICATIONS

Siddharth Maheshwari et al., "*Alternating Current Electrospraying*", Industrial & Engineering Chemistry Research, vol. 48, No. 21, pp. 9358-9368, (Nov. 2009).
(Continued)

*Primary Examiner* — Kiet T Nguyen

(57) ABSTRACT

A method of ionizing a sample is provided, comprising providing a fluid sample, wherein the fluid sample contains an analyte, applying one or more pulses of acoustic energy to the fluid sample to cause a spray of the fluid sample to eject from the surface of the fluid sample, and applying an AC, RF or alternating voltage to the fluid sample using an electrode.

20 Claims, 8 Drawing Sheets

(56) References Cited

U.S. PATENT DOCUMENTS

| | | | | |
|---|---|---|---|---|
| 8,415,619 | B2 | 4/2013 | Goodlett et al. | |
| 8,453,507 | B2 | 6/2013 | Ellson et al. | |
| 2004/0025576 | A1* | 2/2004 | Glauser | B82Y 30/00 73/61.79 |
| 2014/0072476 | A1 | 3/2014 | Otsuka | |
| 2014/0319335 | A1* | 10/2014 | Morris | H01J 49/0454 250/282 |

OTHER PUBLICATIONS

Lisa M. Cousins et al., "*Rapid Detection of Positive and Negative Electrospray Ions Using Millisecond Polarity Switching and a Static Unifield Detector*", http//www.ionics.ca/wp-content/uploads/P111-rapid_detection_of_positive_and_negative_electropsray_ions_using_millisecond_polarity_switching_and_a_static_unifield_detector.pdf, pp. 9359-9365, (May 2010).

J.P. Borra et al., "*Influence of Electric Field Profile and Polarity on the Mode of EHDA Related to Electric Discharge Regimes*", Journal of Aerosol Science, vol. 30, No. 7, pp. 913-925, (Aug. 1999).

* cited by examiner

Single mode

Continuous mode

Ion generation via echo spray & voltage polarity switch

ION SOURCE

CROSS-REFERENCE TO RELATED APPLICATIONS

This application represents the U.S. National Phase of International Application number PCT/GB2015/053091 entitled "Ion Source" filed 16 Oct. 2015, which claims priority from and the benefit of United Kingdom patent application No. 1418511.0, filed 17 Oct. 2014, United Kingdom patent application No. 1502111, filed 9 Feb. 2015 and European patent application No. 14189600.1, filed 20 Oct. 2014. The entire contents of these applications are incorporated herein by reference.

FIELD OF THE INVENTION

The present invention relates generally to mass spectrometry and in particular to mass spectrometers and methods of mass spectrometry. Various embodiments relate to apparatus and methods of ionising a sample and an ion source.

BACKGROUND

It is known to acoustically eject a droplet containing an analyte from a fluid sample and transport the droplet into an interface of a mass spectrometer. An analyte solution may be placed onto a piezoelectric transducer and ultrasound may be applied to produce a single drop that is then transferred into the inlet of a mass spectrometer.

US2004/0118953 (Elrod) discloses a high throughput method and apparatus for introducing biological samples into analytical instruments.

US2012/0145890 (University of Glasgow) discloses methods and systems of mass spectrometry.

US2002/0109084 (Ellson) discloses acoustic sample introduction for mass spectrometric analysis.

US2005/0054208 (Fedorov) discloses electrospray systems and methods.

WO2011/060369 (Goodlett) discloses generating ions using a surface acoustic wave device, and detecting these by mass spectrometry.

US2014/0072476 (Otsuka) discloses an ionisation device, a mass spectrometer using the ionisation device and an image generation system.

It is desired to improve ionisation techniques involving the application of ultrasound to a sample.

SUMMARY

In accordance with an aspect of the invention, there is provided a method of ionising a sample, comprising:

providing a fluid sample, wherein the fluid sample optionally contains an analyte;

applying one or more pulses of acoustic energy to the fluid sample to cause a spray of the fluid sample to eject from the surface of the fluid sample; and applying a voltage, for example an AC, RF or alternating voltage to the fluid sample using an electrode.

It has been found that applying an AC, RF or alternating voltage to the fluid sample improves the stability of operation when ionising a sample as described above. This is distinguished from previous methods, such as those described in US2002/0109084 (Ellson) and US2004/0118953 (Elrod), which do not disclose or suggest applying an alternating voltage to the fluid sample.

The spray may be a mist and/or comprise atomised particles or molecules.

The electrode may be in contact with, or placed within, said fluid sample.

The voltage optionally causes analyte molecules in said spray to ionise.

The step of applying one or more pulses of acoustic energy may comprise causing a drop of the fluid sample to protrude or eject from the surface, and then optionally split into smaller droplets to form the spray.

A single pulse of acoustic energy may be applied to the fluid sample to cause the spray of the fluid sample to eject from the surface of the fluid sample.

The spray may be a spray of droplets, the droplets optionally each having a dimension of <15 μm, <10 μm, <5 μm, <2 μm, or <1 μm. The dimension may be a diameter of said droplet. The droplets may have an average dimension substantially <15 μm, <10 μm, <5 μm, <2 μm, or <1 μm.

The one or more pulses of acoustic energy may have a defined pulse length and/or duration and/or frequency. The one or more pulses of acoustic energy may be applied at a frequency >8 MHz, between 8-15 MHz, between 10-12 MHz or substantially 11 MHz.

The step of applying one or more pulses of acoustic energy may comprise focusing the one or more pulses of acoustic energy, optionally onto the surface of the fluid sample. Additionally, or alternatively, the step of applying one or more pulses of acoustic energy may comprise focusing the one or more pulses of acoustic energy onto a portion of the fluid sample that protrudes or is ejected from the surface, for example the drop, droplet or spray referred to herein.

The method may further comprise providing a sample holder for holding the fluid sample. The sample holder may be resistive, non-conductive, semi-conductive or dielectric. Alternatively, the sample holder may be conductive.

The electrode may be placed adjacent to the sample holder, for example between the sample holder and the means for applying acoustic energy, e.g. acoustic transducer.

The voltage applied to the ion inlet device may be >1 kV, >2 kV, >5 kV or between 5-10 kV. The method may further comprise maintaining the fluid sample at a ground potential, optionally using the electrode. The electrode may contact the fluid sample and/or sample holder directly. The electrode may form or comprise part of the sample holder.

The voltage applied to the fluid sample may cause, or be selected to cause, analyte molecules in the spray to ionise.

The method may comprise applying a DC voltage to the fluid sample and/or electrode, or using the electrode.

The method may comprise applying an AC, RF or alternating voltage to the fluid sample and/or electrode, or using the electrode. The method may comprise switching, repeatedly switching or alternating the voltage applied to the fluid sample and/or electrode, or using the electrode, between different polarities, for example positive and negative polarities, so as to optionally cause analyte molecules in said spray to alternately form negatively and positively charged ions.

The method may comprise supplying an AC, RF or alternating voltage to the fluid sample and/or electrode. The AC, RF or alternating voltage optionally has an amplitude selected from the group consisting of: (i) <50 V peak to peak; (ii) 50-100 V peak to peak; (iii) 100-200 V peak to peak; (iv) 200-500 V peak to peak; (v) 0.5-1 kV peak to peak; (vi) 1-2 kV peak to peak; (vii) 2-3 kV peak to peak; (viii) 3-4 kV peak to peak; (ix) 4-5 kV peak to peak; (x) 5-8 kV peak to peak; and (xi) >8 kV peak to peak.

The AC, RF or alternating voltage optionally has a frequency selected from the group consisting of: (i) <0.1 Hz; (ii) 0.1-0.2 Hz; (iii) 0.2-0.3 Hz; (iv) 0.3-0.4 Hz; (v) 0.4-0.5 Hz; (vi) 0.5-1.0 Hz; (vii) 1.0-2.0 Hz; (viii) 2.0-5.0 Hz; (ix) 5.0-10 Hz; (x) 10-20 Hz; (xi) 20-50 Hz; (xii) 50-100 Hz; (xiii) 100-200 Hz; (xiv) 200-500 Hz; (xv) 0.5-1 kHz; (xvi) 1-2 kHz; (xvii) 2-5 kHz; (xviii) 5-10 kHz; (xix) 10-20 kHz; (xx) 20-50 kHz; (xxi) 50-100 kHz; (xxii) 100-200 kHz; (xxiii) 200-500 kHz; (xxiv) 0.5-1 MHz; and (xxv) >1 MHz.

The AC, RF or alternating voltage optionally has a frequency matching a or the pulse rate of acoustic energy applied to the fluid sample, or a multiple of the pulse rate of acoustic energy applied to the fluid sample.

In accordance with an aspect of the invention, there is provided a method of mass spectrometry, or a method of ion mobility spectrometry, comprising a method as described above.

The method may further comprise providing an ion inlet device having an inlet orifice, and may further comprise transporting analyte ions in the spray of fluid sample through the inlet orifice.

The method may further comprise applying a voltage to the ion inlet device, optionally using an electrode. The voltage applied to the ion inlet device may be >1 kV, >2 kV, >5 kV or between 5-10 kV, and may be a DC, AC, RF or alternating voltage. The method may further comprise maintaining the ion inlet device at a ground potential, optionally using the electrode. The electrode may contact the ion inlet device. The ion inlet device may comprise a sampling tube, and the electrode may contact the sampling tube. The sampling tube may lead to a first vacuum stage of a mass spectrometer. The sampling tube may have an inlet orifice, and the electrode may form part of the inlet orifice, or be positioned substantially adjacent said inlet orifice.

The method may further comprise:

(a) holding the sample holder and/or the fluid sample at a relatively high potential, and optionally holding the ion inlet device at a relatively low or ground potential, such that the volume between the sample holder and/or the fluid sample and the ion inlet device may form an electrolytic capacitor; and/or (b) holding the ion inlet device at a relatively high potential, and optionally holding the sample holder and/or the fluid sample at a relatively low or ground potential, such that the volume between the sample holder and/or the fluid sample and the ion inlet device may form an electrolytic capacitor.

The method may further comprise switching or repeatedly switching between (a) and (b) in a mode of operation, optionally at a frequency selected from the group consisting of: (i) <0.1 Hz; (ii) 0.1-0.2 Hz; (iii) 0.2-0.3 Hz; (iv) 0.3-0.4 Hz; (v) 0.4-0.5 Hz; (vi) 0.5-1.0 Hz; (vii) 1.0-2.0 Hz; (viii) 2.0-5.0 Hz; (ix) 5.0-10 Hz; (x) 10-20 Hz; (xi) 20-50 Hz; (xii) 50-100 Hz; (xiii) 100-200 Hz; (xiv) 200-500 Hz; (xv) 0.5-1 kHz; (xvi) 1-2 kHz; (xvii) 2-5 kHz; (xviii) 5-10 kHz; (xix) 10-20 kHz; (xx) 20-50 kHz; (xxi) 50-100 kHz; (xxii) 100-200 kHz; (xxiii) 200-500 kHz; (xxiv) 0.5-1 MHz; and (xxv) >1 MHz.

The fluid sample may form the electrolyte in the electrolytic capacitor.

The method may further comprise maintaining a constant potential difference between the sample holder and/or the fluid sample and the ion inlet device.

The method may further comprise maintaining a constant distance between an inlet orifice of the ion inlet device and a surface of the fluid sample, for example in response to changes in the level or volume of the fluid sample.

According to an aspect of the invention, there is provided an ion source or mass spectrometer arranged and adapted to carry out the methods of ionising a sample, or methods of mass spectrometry described above.

According to an aspect of the invention, there is provided an ion inlet device or ion source comprising:

a sample holder and an acoustic transducer, wherein the sample holder is for containing a fluid sample, and the acoustic transducer is arranged and adapted to apply one or more pulses of acoustic energy to the fluid sample to cause a spray of the fluid sample to eject from a surface of the fluid sample; and a control system arranged and adapted to apply a voltage, for example an AC, RF or alternating voltage, to the fluid sample or sample holder.

According to an aspect of the invention, there is provided a mass spectrometer comprising an ion inlet device or ion source as described above.

According to an aspect of the invention, there is provided a method of ionising a sample, comprising:

providing a fluid sample, wherein the fluid sample contains an analyte;

applying one or more pulses of acoustic energy to the fluid sample to cause a drop, stream or spray of the fluid sample to eject from the surface of the fluid sample; and applying a voltage to the fluid sample, optionally so as to cause analyte molecules in the drop, stream or spray to ionise and/or polarise.

The voltage may be applied to the fluid sample by an electrode, and may be a DC, AC, RF or alternating voltage. The electrode may be positioned within the sample. Alternatively, a sample holder may be provided for holding the sample, and the voltage may be applied to the fluid sample via the sample holder. The sample holder may be conductive, or made from a conductive material, and arranged and adapted to apply a voltage to the sample when a voltage is applied to the sample holder.

The method may further comprise:

(a) holding the sample holder and/or the fluid sample at a relatively high potential, and optionally holding the ion inlet device at a relatively low or ground potential, such that the volume between the sample holder and/or the fluid sample and the ion inlet device may form an electrolytic capacitor; and/or (b) holding the ion inlet device at a relatively high potential, and optionally holding the sample holder and/or the fluid sample at a relatively low or ground potential, such that the volume between the sample holder and/or the fluid sample and the ion inlet device may form an electrolytic capacitor.

The method may further comprise switching or repeatedly switching between (a) and (b) in a mode of operation, optionally at a frequency selected from the group consisting of: (i) <0.1 Hz; (ii) 0.1-0.2 Hz; (iii) 0.2-0.3 Hz; (iv) 0.3-0.4 Hz; (v) 0.4-0.5 Hz; (vi) 0.5-1.0 Hz; (vii) 1.0-2.0 Hz; (viii) 2.0-5.0 Hz; (ix) 5.0-10 Hz; (x) 10-20 Hz; (xi) 20-50 Hz; (xii) 50-100 Hz; (xiii) 100-200 Hz; (xiv) 200-500 Hz; (xv) 0.5-1 kHz; (xvi) 1-2 kHz; (xvii) 2-5 kHz; (xviii) 5-10 kHz; (xix) 10-20 kHz; (xx) 20-50 kHz; (xxi) 50-100 kHz; (xxii) 100-200 kHz; (xxiii) 200-500 kHz; (xxiv) 0.5-1 MHz; and (xxv) >1 MHz.

The fluid sample may form the electrolyte in a or the electrolytic capacitor.

A method of mass spectrometry, or a method of ion mobility spectrometry, may comprise the method of ionising a sample referred to above.

The method may further comprise providing an ion inlet device having an inlet orifice, and may further comprise transporting analyte ions in the drop, stream or spray of fluid sample through the inlet orifice.

The method may further comprise applying a voltage to the ion inlet device, optionally using an electrode. The voltage applied to the ion inlet device may be >1 kV, >2 kV, >5 kV or between 5-10 kV, and may be an DC, AC, RF or alternating voltage. The method may further comprise maintaining the ion inlet device at a ground potential, optionally using the electrode. The electrode may contact the ion inlet device. The ion inlet device may comprise a sampling tube, and the electrode may contact the sampling tube. The sampling tube may lead to a first vacuum stage of a mass spectrometer. The sampling tube may have an inlet orifice, and the electrode may form part of the inlet orifice, or be positioned substantially adjacent said inlet orifice.

The method may further comprise maintaining a constant potential difference between the sample holder and/or the fluid sample and the ion inlet device.

The method may further comprise maintaining a constant distance between an inlet orifice of the ion inlet device and a surface of the fluid sample, for example in response to changes in the level or volume of the fluid sample.

According to an aspect of the invention, there is provided an ion source comprising:

a sample holder and an acoustic transducer, wherein the sample holder is for containing a fluid sample, and the acoustic transducer is arranged and adapted to apply one or more pulses of acoustic energy to the fluid sample to cause a drop, stream or spray of the fluid sample to eject from the surface of the fluid sample; and an electrode arranged and adapted to apply a voltage to the fluid sample, optionally so as to cause analyte molecules in the drop, stream or spray to ionise and/or polarise.

According to an aspect of the invention, there is provided a method of ionising a sample, comprising:

providing a fluid sample, wherein the fluid sample contains an analyte, and an inlet orifice for a mass spectrometer, wherein a distance is defined between a surface of the fluid sample and the inlet orifice;

applying one or more pulses of acoustic energy to the fluid sample to cause a drop, stream or spray of the fluid sample to eject from the surface of the fluid sample; and maintaining a substantially constant distance between a surface of the fluid sample and the inlet orifice in response to a change in level or volume of the fluid sample.

According to an aspect of the invention, there is provided an ion inlet device comprising:

a sample holder and an acoustic transducer, wherein the sample holder is for containing a fluid sample, and the acoustic transducer is arranged and adapted to apply one or more pulses of acoustic energy to the fluid sample to cause a drop, stream or spray of the fluid sample to eject from the surface of the fluid sample;

an inlet orifice for a mass spectrometer; and means arranged and adapted to maintain a substantially constant distance between a surface of the fluid sample and the inlet orifice in response to a change in level or volume of the fluid sample.

In accordance with an aspect of the invention, there is provided a method of ionising a sample, comprising:

providing a fluid sample, wherein the fluid sample optionally contains an analyte;

applying one or more pulses of acoustic energy to the fluid sample to cause a drop of the fluid sample to protrude or eject from the surface of the fluid sample; and applying energy to said drop such that said drop is caused to fragment into a number of smaller droplets, optionally forming a spray.

The spray may be a mist and/or comprise atomised particles.

The step of applying energy to said drop may comprise applying at least one of acoustic, laser and heat energy to said drop, optionally as it is protruding or ejecting from the surface of the fluid sample.

The method may further comprise ionising the droplets or spray to form ionised particles. The method may comprise transporting the droplets, spray or ionised particles into an inlet of a mass spectrometer.

The method may further comprise applying a voltage to the fluid sample, for example a DC, AC, RF or alternating voltage, optionally so as to cause analyte molecules in the spray to ionise and/or polarise.

The voltage may be applied to the fluid sample by an electrode. The electrode may be positioned within the sample. Alternatively, a sample holder may be provided for holding the sample, and the voltage may be applied to the fluid sample via the sample holder. The sample holder may be conductive, or made from a conductive material, and arranged and adapted to apply a voltage to the sample when a voltage is applied to the sample holder.

The method may further comprise:

(a) holding the sample holder and/or the fluid sample at a relatively high potential, and optionally holding the ion inlet device at a relatively low or ground potential, such that the volume between the sample holder and/or the fluid sample and the ion inlet device may form an electrolytic capacitor; and/or (b) holding the ion inlet device at a relatively high potential, and optionally holding the sample holder and/or the fluid sample at a relatively low or ground potential, such that the volume between the sample holder and/or the fluid sample and the ion inlet device may form an electrolytic capacitor.

The method may further comprise switching or repeatedly switching between (a) and (b) in a mode of operation, optionally at a frequency selected from the group consisting of: (i) <0.1 Hz; (ii) 0.1-0.2 Hz; (iii) 0.2-0.3 Hz; (iv) 0.3-0.4 Hz; (v) 0.4-0.5 Hz; (vi) 0.5-1.0 Hz; (vii) 1.0-2.0 Hz; (viii) 2.0-5.0 Hz; (ix) 5.0-10 Hz; (x) 10-20 Hz; (xi) 20-50 Hz; (xii) 50-100 Hz; (xiii) 100-200 Hz; (xiv) 200-500 Hz; (xv) 0.5-1 kHz; (xvi) 1-2 kHz; (xvii) 2-5 kHz; (xviii) 5-10 kHz; (xix) 10-20 kHz; (xx) 20-50 kHz; (xxi) 50-100 kHz; (xxii) 100-200 kHz; (xxiii) 200-500 kHz; (xxiv) 0.5-1 MHz; and (xxv) >1 MHz.

The fluid sample may form the electrolyte in a or the electrolytic capacitor.

A method of mass spectrometry, or a method of ion mobility spectrometry, may comprise the method of ionising a sample referred to above.

The method may further comprise providing an ion inlet device having an inlet orifice, and may further comprise transporting analyte ions in the drop, stream or spray of fluid sample through the inlet orifice.

The method may further comprise applying a voltage to the ion inlet device, optionally using an electrode. The voltage applied to the ion inlet device may be >1 kV, >2 kV, >5 kV or between 5-10 kV, and may be a DC, AC, RF or alternating voltage. The method may further comprise maintaining the ion inlet device at a ground potential, optionally using the electrode. The electrode may contact the ion inlet device. The ion inlet device may comprise a sampling tube, and the electrode may contact the sampling tube. The sampling tube may lead to a first vacuum stage of a mass spectrometer. The sampling tube may have an inlet orifice, and the electrode may form part of the inlet orifice, or be positioned substantially adjacent said inlet orifice.

The method may further comprise maintaining a constant potential difference between the sample holder and/or the fluid sample and the ion inlet device.

The method may further comprise maintaining a constant distance between an inlet orifice of the ion inlet device and a surface of the fluid sample, for example in response to changes in the level or volume of the fluid sample.

In accordance with an aspect of the invention, there is provided an ion inlet device or ion source comprising:

a sample holder and an acoustic transducer, wherein the sample holder is for containing a fluid sample, and the acoustic transducer is arranged and adapted to apply one or more pulses of acoustic energy to the fluid sample to cause a drop of the fluid sample to protrude or eject from the surface of the fluid sample; and means arranged and adapted to apply energy to said drop such that said drop is caused to fragment into a number of smaller droplets, optionally forming a spray.

The means to apply energy may comprise at least one of an acoustic transducer, a laser and a heater, for example a hot probe.

In accordance with an aspect of the invention, there is provided a method of ionising a sample, comprising:

providing a fluid sample, wherein the fluid sample is contained within a sample holder and comprises an analyte;

providing an acoustic transducer for applying acoustic energy to the fluid sample;

providing a first electrode located between the fluid sample or the sample holder and the acoustic transducer, and a second electrode located above the sample holder; and maintaining a potential difference between the first electrode and the second electrode such that the volume between the first electrode and the second electrode forms an electrolytic capacitor, and fluid sample contained in the sample holder forms the electrolyte of the electrolytic capacitor; and applying one or more pulses of acoustic energy to the fluid sample to cause a drop, stream or spray of the fluid sample to eject from the surface of the fluid sample.

In accordance with an aspect of the invention, there is provided an ion inlet device or ion source comprising:

a sample holder and an acoustic transducer, wherein the sample holder is for containing a fluid sample, and the acoustic transducer is arranged and adapted to apply one or more pulses of acoustic energy to the fluid sample to cause a drop, stream or spray of the fluid sample to eject from the surface of the fluid sample;

a first electrode located between the fluid sample or sample holder and the acoustic transducer;

a second electrode located above the sample holder; and a control system arranged and adapted:

to maintain a potential difference between the first and second electrodes such that the volume between the first electrode and the second electrode forms an electrolytic capacitor, and fluid sample contained in the sample holder forms, in use, the electrolyte of the electrolytic capacitor.

The first electrode may be built into or form part of the sample holder. Alternatively, the first electrode may be separate from the sample holder. The first electrode may be a plate, mesh or grid electrode. The sample holder may be a cup, and the electrode may be located over and/or at least partially surround the bottom surface of the cup.

The sample holder may be resistive, non-conductive, semi-conductive or dielectric. Alternatively, the sample holder may be conductive.

The potential difference maintained between the first and second electrodes optionally causes, in use, analyte molecules in the spray to ionise.

The method may further comprise maintaining a constant distance between the second electrode and a surface of the fluid sample, for example in response to changes in the level or volume of the fluid sample in use.

In any of the embodiments or aspects described above, the voltage applied to the fluid sample and/or electrode, or using the electrode, may be a DC, AC, RF or alternating voltage. The voltage applied to the fluid sample and/or electrode, or using the electrode, may be switched, repeatedly switched or alternated between different polarities, for example positive and negative polarities, so as to optionally cause analyte molecules in said spray to alternately form negatively and positively charged ions.

The voltage applied to the fluid sample and/or electrode, or using the electrode, may comprise an AC, RF or alternating voltage. The AC, RF or alternating voltage optionally has an amplitude selected from the group consisting of: (i) <50 V peak to peak; (ii) 50-100 V peak to peak; (iii) 100-200 V peak to peak; (iv) 200-500 V peak to peak; (v) 0.5-1 kV peak to peak; (vi) 1-2 kV peak to peak; (vii) 2-3 kV peak to peak; (viii) 3-4 kV peak to peak; (ix) 4-5 kV peak to peak; (x) 5-8 kV peak to peak; and (xi) >8 kV peak to peak.

The AC, RF or alternating voltage optionally has a frequency selected from the group consisting of: (i) <0.1 Hz; (ii) 0.1-0.2 Hz; (iii) 0.2-0.3 Hz; (iv) 0.3-0.4 Hz; (v) 0.4-0.5 Hz; (vi) 0.5-1.0 Hz; (vii) 1.0-2.0 Hz; (viii) 2.0-5.0 Hz; (ix) 5.0-10 Hz; (x) 10-20 Hz; (xi) 20-50 Hz; (xii) 50-100 Hz; (xiii) 100-200 Hz; (xiv) 200-500 Hz; (xv) 0.5-1 kHz; (xvi) 1-2 kHz; (xvii) 2-5 kHz; (xviii) 5-10 kHz; (xix) 10-20 kHz; (xx) 20-50 kHz; (xxi) 50-100 kHz; (xxii) 100-200 kHz; (xxiii) 200-500 kHz; (xxiv) 0.5-1 MHz; and (xxv) >1 MHz.

The AC, RF or alternating voltage optionally has a frequency matching a or the pulse rate of acoustic energy applied to the fluid sample, or a multiple of the pulse rate of acoustic energy applied to the fluid sample.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source.

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments of the present invention will now be described, together with an example for illustration only, by way of example only, and with reference to the accompanying drawings in which.

DETAILED DESCRIPTION

Various embodiments of the present disclosure will now be described.

Figure 1:
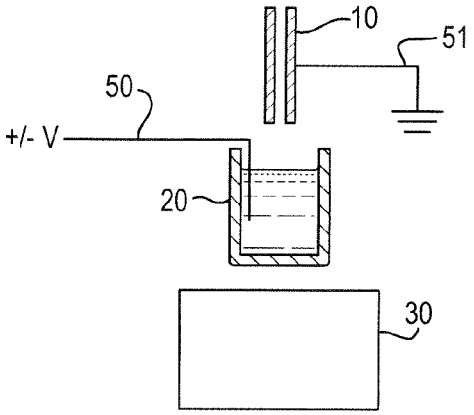
FIG. 1 shows a schematic of an embodiment of the present disclosure.

An ion source in accordance with an embodiment is shown in FIG. 1.

An electrode 50 is optionally inserted into a vial 20, optionally containing a sample of analyte solution. A sampling tube 10 is optionally connected to a mass spectrometer and may be positioned over the vial 10. A pulse of acoustic energy may be produced by a transducer 30. The pulse is optionally focused onto to the surface of the sample or analyte solution, which optionally causes a stream or spray of droplets to be emitted.

An electrode 50 is optionally placed inside the analyte vial 20 so that it is able to apply a voltage directly to the sample or analyte solution. As the droplets leave the sample they may polarise and/or desolvate, optionally forming protonated or deprotonated ions depending upon the voltages applied. These ions are then optionally analysed using the mass spectrometer.

For the sake of simplicity, only one vial 20 is shown in FIG. 1. However, it is understood in practice that the sample reservoir or holder may also be or comprise a collection of reservoirs, for example in the form of racked tubes or microtiter plates. The sample reservoir or holder could also be an individual tube or vial.

Figure 2:
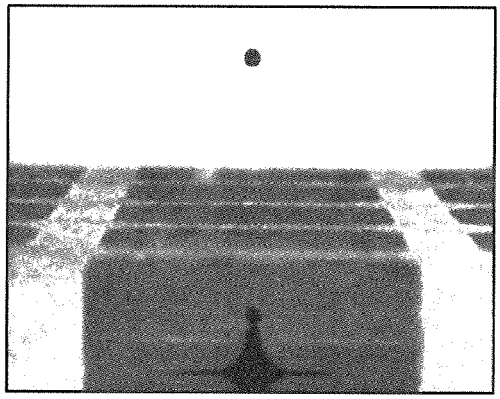
FIG. 2 shows droplet ejection in accordance with a prior art configuration.

In order for the system to produce ions the acoustic set up is modified from conventional conditions used for acoustic liquid transfer, which may be configured to provide a single droplet of known volume, typically of the order 2.5 nL in volume, and/or having a diameter of approximately 170 μm, as shown in FIG. 2.

Figure 3A:
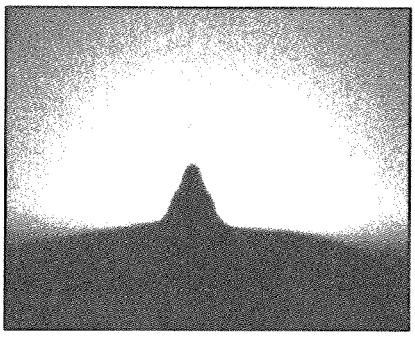
FIGS. 3A and 3B illustrate droplet ejection under modified conditions.
Figure 3B:
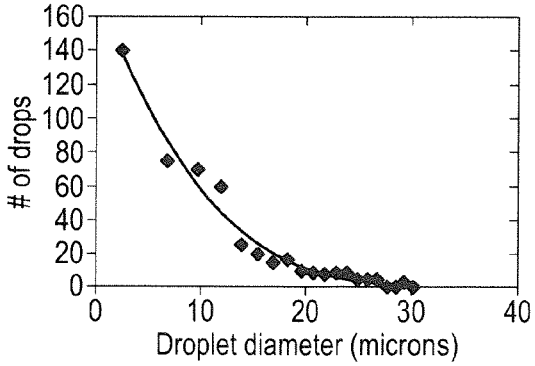

In accordance with the various embodiments, these conventional conditions may be altered to form a stream or spray of smaller droplets, for example having a volume less than 1 pL, optionally less than 100 fL, and/or a diameter of less than 15 μm. FIG. 3A is a photograph showing a stream of droplets emitted, using droplet ejection under modified conditions. FIG. 3B shows a typical droplet diameter distribution. A typical sonic frequency to produce a stream or spray of smaller droplets may be greater than 10 MHz, and optionally 10-12 MHz or 11 MHz.

Lower frequency and/or longer wavelength pulses may produce larger droplets, e.g. droplets having a large or larger diameter. Higher frequency and/or shorter wavelength pulses may produce smaller droplets, e.g. droplets having a small or smaller diameter. Droplet volume may be controlled and/or reproducible. The production rate of droplets, or the amount of droplets in the spray, may be greater than 200 droplets per second, optionally 200-1000 droplets per second.

In accordance with various embodiments, the application of a voltage to the sample or analyte solution optionally results in the formation of an electrical circuit, wherein the air gap and/or analyte between the sampling tube and vial (or a counter electrode) becomes the dielectric of an electrolytic capacitor. The sample or analyte solution optionally forms the electrolyte of the electrolytic capacitor. The droplets are optionally polarised as they align opposite to the electric field, and are optionally ionised in an electro-spray like process as they leave the surface. The protonation of the sample may be driven by the voltage applied to the sample or analyte solution. It should be noted that the solvents generally used in mass spectrometry, for example methanol (33.1), water (80.4), may have quite high relative permittivity $\in_r$.

Figure 4:
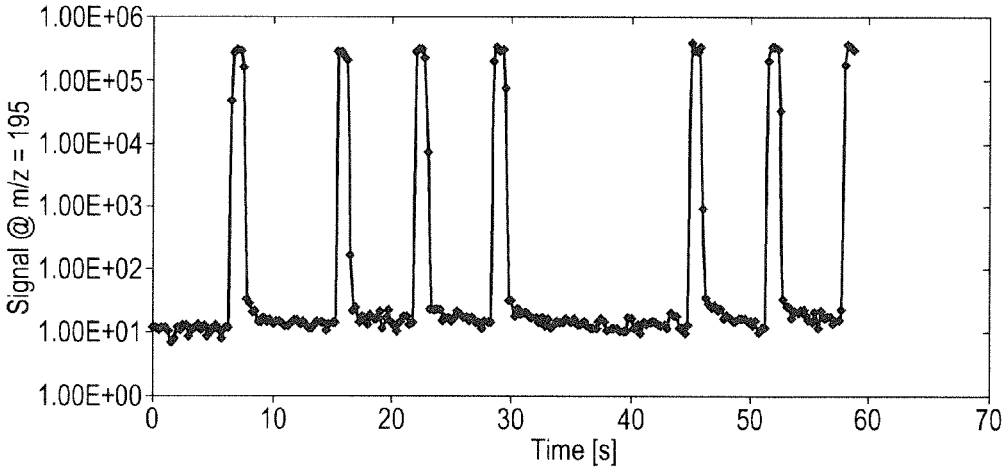
FIG. 4 shows the $[M+H]^+$ response to the ejection of caffeine.

FIG. 4 shows the $[M+H]^+$ response of the mass spectrometer to the ejection of caffeine, with approximately 250 nL ejected from a 10 μg/mL solution in water, containing 0.1% formic acid. Note that the intensity scale in FIG. 4 is logarithmic, and that the signal drops to the background level quickly on the cessation of the acoustic energy. The voltage applied to the analyte can be greater than 1 kV, and optionally greater than or substantially equal to 2 kV. The droplet ejection rate may be greater than or equal to 500 Hz.

Figure 5:
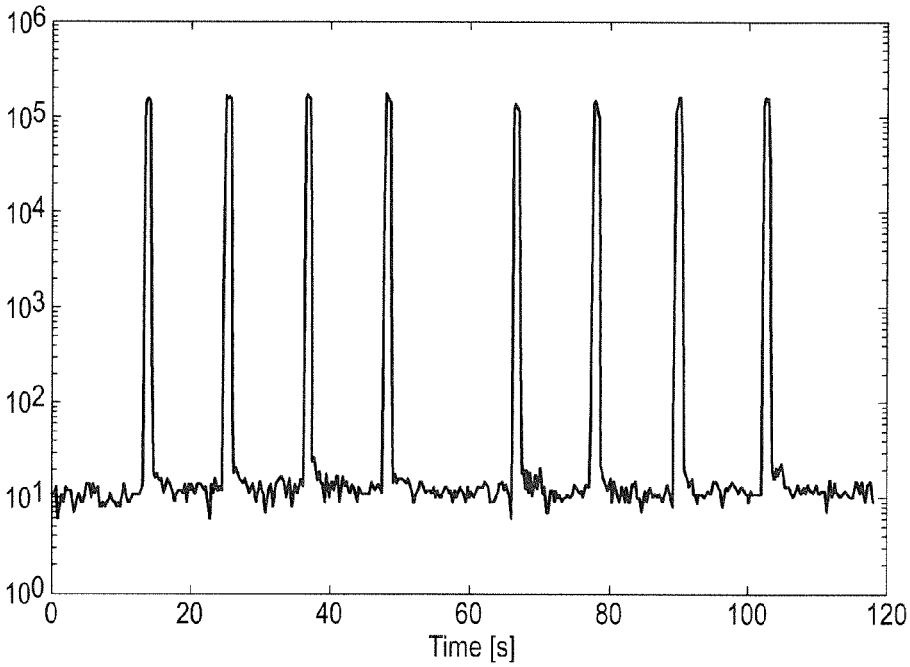
FIG. 5 shows the $[M+2H]^{2+}$ response to the ejection of Glu-fibrino peptide.

FIG. 5 shows the $[M+2H]^{2+}$ response of the mass spectrometer to the ejection of Glu-fibrino peptide (63 mM in water and 0.1% formic acid). Again, the intensity scale is logarithmic and drops immediately to the background level on the cessation of the acoustic energy. This optionally shows the formation of multiply charged positive ions.

Figure 6A:
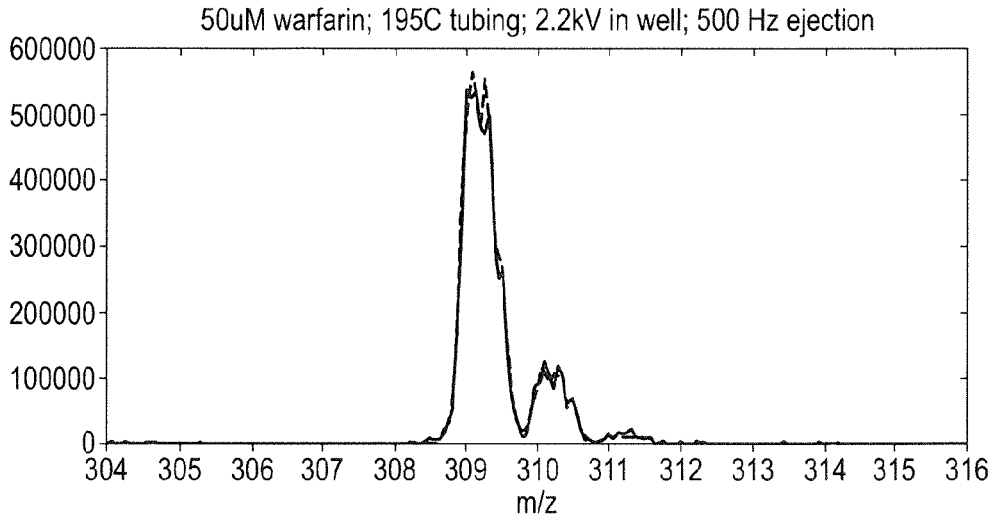
FIGS. 6A and 6B show two mass spectra obtained from Wafarin.
Figure 6B:
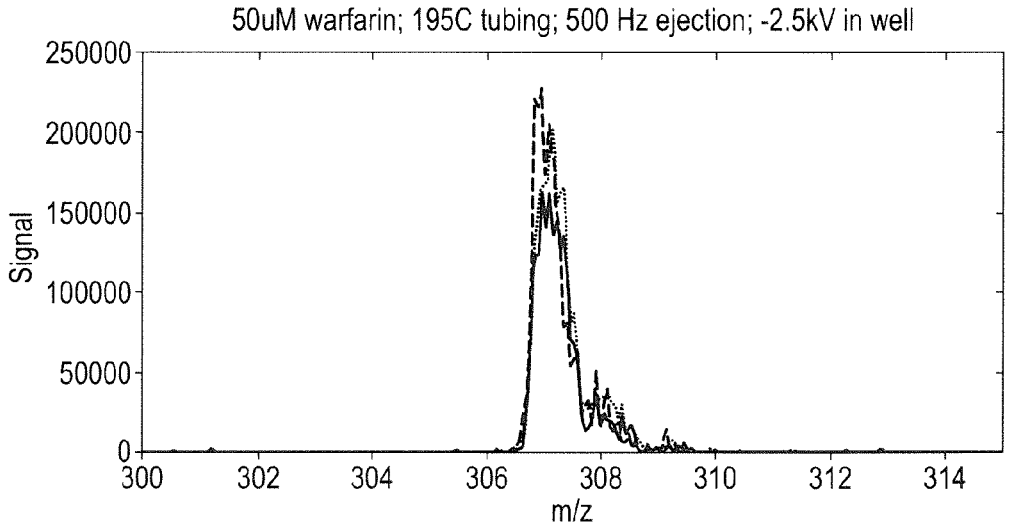

FIGS. 6A and 6B show mass spectra obtained from Wafarin (50 mM). FIG. 6A is a first mass spectrum using positive ion mode (+2.2 kV applied to the liquid), and showing the $[M+H]^+$ ion at 309 Da. FIG. 6B is a second mass spectrum using negative ion mode, and showing the $[M-H]^-$ ion at 307 Da.

Figure 7:
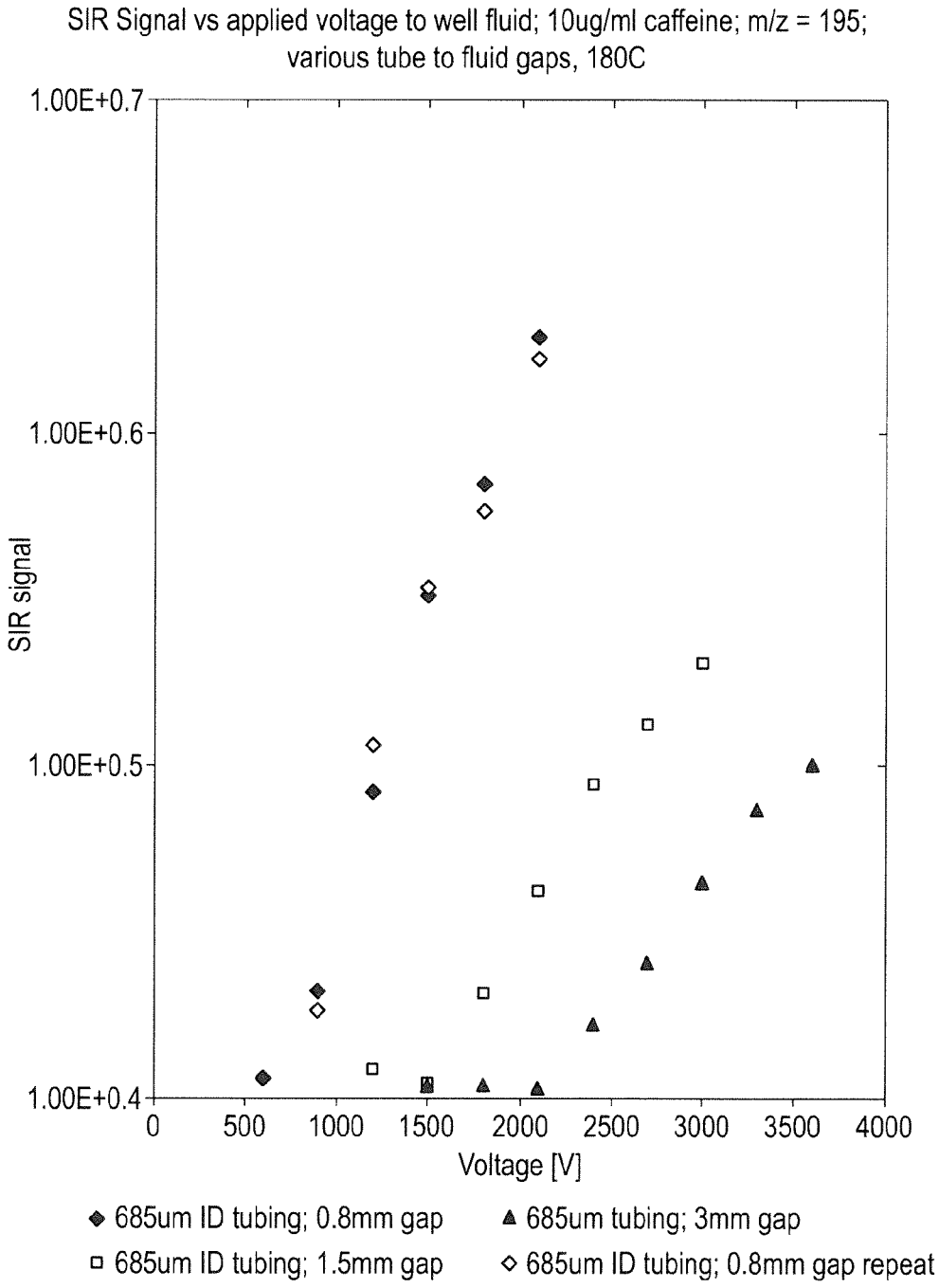
FIG. 7 shows the effect of liquid surface to sampling nozzle distance.

The effect of the spacing of the sampling tube 10 (or electrode) from the surface of the sample or analyte solution on the intensity of the MS signal has been investigated and shown in FIG. 7.

The distance between the sampling tube 10 to the surface of the sample or analyte solution may be an important parameter in the reproducibility and efficiency of this mass spectrometer. In various embodiments, this distance is closely controlled. The surface position may be already measured using acoustic methods, and optionally during auto set up of the acoustic solvent delivery system, and so this may be used as a closed loop feedback parameter. The surface position, or the distance between the sampling tube 10 to the surface of the sample or analyte solution, may be measured using a laser, for example laser range finding, or using capacitance changes, etc.

A laser or hot probe may be used to generate the droplets of a correct size and/or volume distribution.

Figure 8:
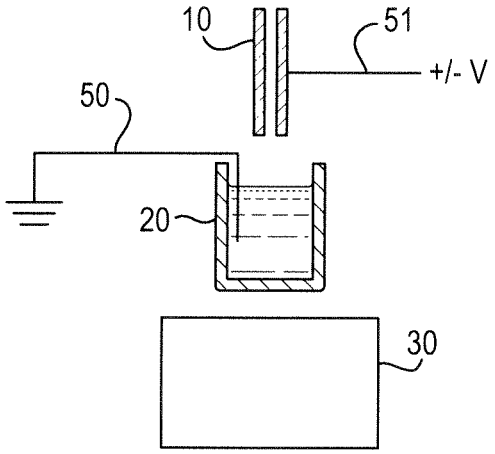
FIG. 8 shows a schematic of an embodiment.

Different geometries for applying the field are envisaged, for example a more practicable approach may be to apply the high voltage to the sampling nozzle as shown in FIG. 8.

Conductive sample plates or analyte vials could be used. This would enable the grounding to be provided through the solid portions of the containers to each of the fluid samples in the reservoirs.

Figure 9:
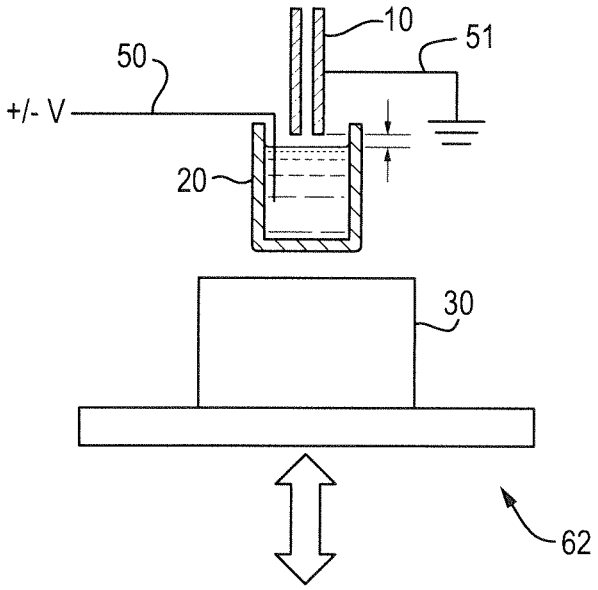
FIG. 9 shows a schematic of an embodiment in which a controller may be used to maintain a constant distance between a fluid sample and an inlet device.

FIG. 9 shows a further modification that optionally maintains a consistent gap or distance from the sampling tube 10 to the surface of the sample or analyte solution, optionally based on measurement of the fluid height.

The use of sonar and acoustic impedance measurements has been described previously (see, for example, U.S. Pat. No. 8,453,507 to Labcyte, Inc.) in order to calculate the fluid depth. Such a measurement can be made prior to generating drops from each well and optionally periodically to find if the well has changed. Reasons for the change could be fluid transfer, evaporation or an increase in fluid from absorption from the atmosphere. The fluid depth information for each well can then provide motion instructions to a positioning means 62, which then optionally adjusts the distance between the sampling tube 10 and the surface of the sample or analyte solution, to optionally ensure that this distance or gap remains consistent and/or constant.

A predetermined distance between the sampling tube 10 and the surface of the sample or analyte solution may be measured and/or recorded, and the positioning means 62 may adjust the distance between the sampling tube 10 and the surface of the sample or analyte solution to maintain it at the predetermined distance.

Maintaining a constant voltage and/or distance between the sampling tube 10 and the surface of the sample or analyte solution, may provide a consistent field strength between the sample and sampling tube 10.

Alternatively, it may be possible to maintain the field constant by measuring the distance between the sampling tube 10 and the surface of the sample or analyte solution and altering the applied voltage.

Optionally, for some fluids and analytes, improved signal quality for the analyte of interest in the mass spectrometer may be achieved when the sampling tube 10 or inlet orifice is positioned within the sample reservoir. Hence, the outer diameter of the inlet orifice may be sufficiently small to facilitate entry into the reservoir and to produce adequate field strength, optionally without arcing to the reservoir wall. Reducing the gap distance to the fluid may allow for absolute voltage reduction to minimize this potential and increase the robustness of sample loading and signal quality.

Figure 10A:
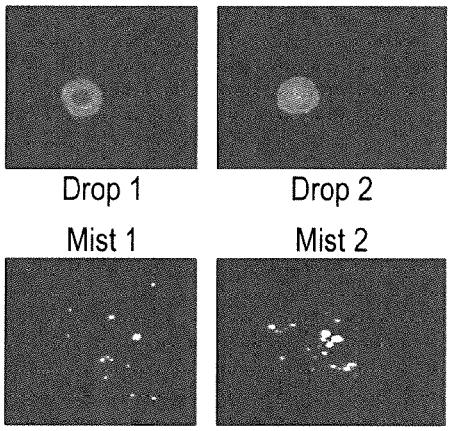
FIG. 10 shows a comparison of drop and spray or mist modes of operation.
Figure 10B:
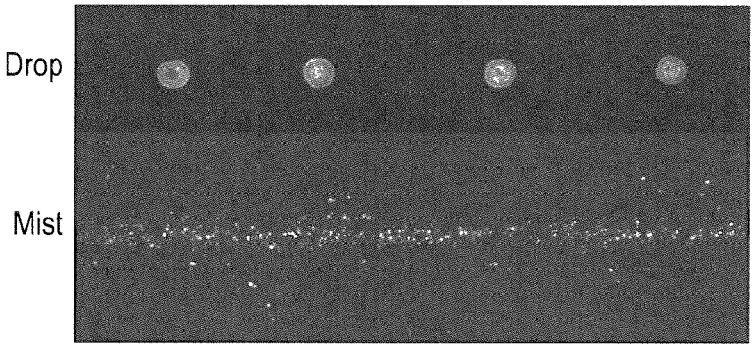
Figure 10C:
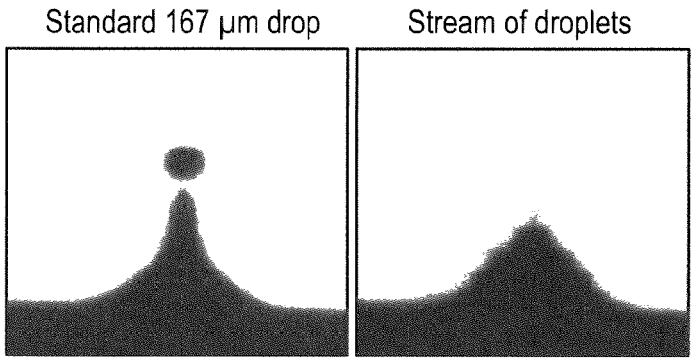

Droplet sizes, flow rates and droplet size distribution requirements may vary by analytical instrument and/or interface. Various embodiments create droplets in the form of a spray or mist, and such instrument modes optionally remain compatible with existing acoustic microplates. FIGS. 10A-10C show the difference between a drop instrument mode and a spray or mist instrument mode.

In a drop instrument mode the acoustic transducer 30 may apply a pulse of acoustic energy to the surface of the sample that can cause a single drop to emerge from the surface of the sample. This single drop may then be ionised and may be transported into the sampling tube 10 due to e.g. vacuum pumping.

In a spray or mist instrument mode the acoustic transducer 30 may apply a pulse of acoustic energy to the surface of the sample that can cause a spray or mist to emerge from the surface of the sample. Analyte molecules in this spray or mist may then be ionised and may be transported into the sampling tube 10 due to e.g. vacuum pumping.

In a mode of operation the polarity of the voltage applied to the sample and/or electrode may be switched between positive and negative polarities. The voltage applied in such a case may be an AC, RF or alternating voltage. Alternatively, a voltage device may be arranged and adapted to switch between voltage polarities in use. Application of a positive voltage optionally causes production of negative ions to form from the droplet, stream or spray. Application of a negative voltage optionally causes production of positive ions to form from the droplet, stream or spray. The mass spectrometer may be arranged to detect positive and/or negative ions.

These modes of operation can reduce charging instabilities in the fluid sample, or sample holder. For example, switching polarities may dissipate charge that builds up in the fluid sample, or sample holder.

Figure 11:
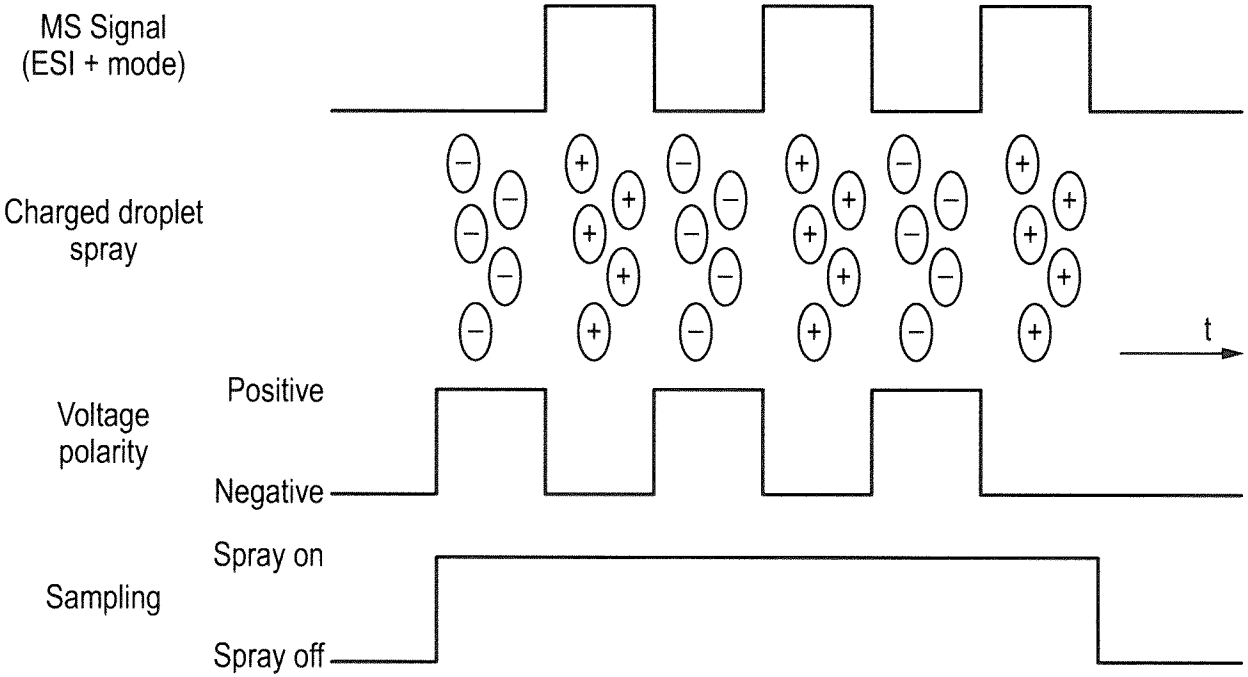
FIG. 11 shows the mass spectrometer signal in a mode of operation.

An example of this mode of operation is shown in FIG. 11, in which it can be seen that switching between positive and negative voltage polarities optionally results in the alternating production of negative and positive ions. The mass spectrometer may be arranged and adapted, or configured to detect positive ions, as shown in FIG. 11. This means that negative ions may not be detected. In various embodiments, the mass spectrometer can be arranged and adapted to switch between detecting positive and negative ions in synchronisation with the switching between positive and negative voltage polarities as described herein.

Alternatively, the mass spectrometer may be arranged and adapted, or configured to switch between detection of positive and negative ions at the same switching frequency as the AC, RF or alternating voltage. In this manner, all ions would be detected by the mass spectrometer.

The voltage applied in these modes of operation may be between 5-10 kV, and optionally 8-10 kV. The switching frequency may be provided to match the rate of drop, droplet, stream or spray ejection, or may be triggered by ejection of a drop, droplet, stream or spray from the fluid sample. The switching frequency may be a multiple of the rate of drop, droplet, stream or spray ejection, optionally so that the polarity is switched more than once per ejection cycle. The switching frequency may be <1 HZ, <2 Hz, <5 Hz or <10 Hz, and is optionally between 0.5-5 Hz.

Figure 12A:
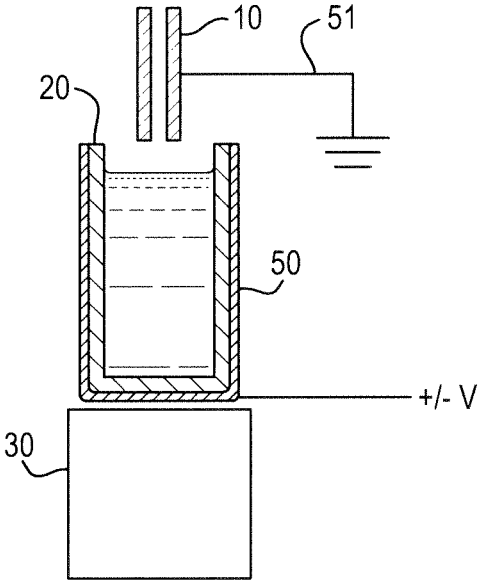
FIG. 12A shows a schematic of an embodiment in which an electrode may surround and/or form part of a sample holder and FIG. 12B shows a schematic of an embodiment in which an electrode may be placed at least partially between a sample holder and an acoustic transducer.

FIG. 12A shows an ion source in accordance with an embodiment in which a sample holder 20 may be used to retain the sample or analyte solution. The sample holder 20 may be resistive, non-conductive, semi-conductive or dielectric. An electrode 50 may at least partially surround the sample holder 20 but optionally does not contact the sample or analyte solution. In various embodiments, the electrode 50 may be built into the sample holder 20 whilst still not contacting the sample or analyte solution itself.

Figure 12B:
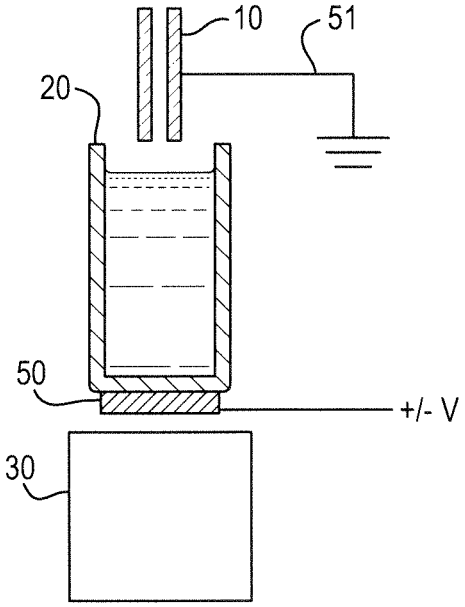

FIG. 12B shows a similar arrangement in which a plate, mesh or grid electrode may be located beneath the sample holder 20, and optionally between the sample holder 20 and the acoustic transducer 30.

The other parts of the ion source of the embodiments as shown in FIGS. 12A and 12B, with like reference numerals, may be the same as discussed above.

In the embodiments as shown in FIGS. 12A and 12B, a voltage, for example a DC, AC, RF or alternating voltage may be applied to the electrode 50 and the sampling tube 10 may be held at a ground potential. Alternatively, the electrode 50 may be held at a ground potential, and a DC, AC, RF or alternating voltage may be applied to the sampling tube 10. The embodiments as shown in FIGS. 12A and 12B may be used with any of the modes of operation discussed above, including the modes of operation in which the polarity of the voltage applied to the sampling tube 10 and/or electrode 50 may be switched between positive and negative polarities.

Although the present invention has been described with reference to various embodiments, it will be understood by those skilled in the art that various changes in form and detail may be made without departing from the scope of the invention as set forth in the accompanying claims.

The invention claimed is:

1. A method of ionizing a sample, comprising:

providing a fluid sample, wherein said fluid sample contains an analyte;

applying one or more pulses of acoustic energy to said fluid sample to cause a spray of said fluid sample to eject from the surface of said fluid sample; and applying an AC, RF or alternating voltage to said fluid sample using an electrode.

2. A method as claimed in claim 1, further comprising switching, repeatedly switching or alternating the voltage applied to said fluid sample between different polarities so as to cause analyte molecules in said spray to alternately form negatively and positively charged ions.

3. A method as claimed in claim 2, wherein said voltage causes analyte molecules in said spray to ionize.

4. A method as claimed in claim 1, wherein said applying one or more pulses of acoustic energy comprises causing a drop of said fluid sample to protrude or eject from said surface, and then split into smaller droplets to form said spray.

5. A method as claimed in claim 1, wherein a single pulse of acoustic energy is applied to said fluid sample to cause said spray of said fluid sample to eject from the surface of said fluid sample.

6. A method as claimed in claim 1, wherein said spray is a spray of droplets, said droplets each having a dimension <15 μm.

7. A method as claimed in claim 1, wherein said one or more pulses of acoustic energy are applied at a frequency between 8-15 MHz.

8. A method as claimed in claim 1, wherein said applying one or more pulses of acoustic energy comprises focusing said one or more pulses of acoustic energy onto said surface of said fluid sample.

9. A method of mass spectrometry comprising a method as claimed in claim 1.

10. A method of mass spectrometry as claimed in claim 9, further comprising providing an ion inlet device having an inlet orifice, and transporting analyte ions in said spray of fluid sample through said inlet orifice.

11. A method of mass spectrometry as claimed in claim 10, further comprising:

(a) holding said fluid sample or electrode at a relatively high potential, and holding said ion inlet device at a relatively low or ground potential, such that the volume between the fluid sample or electrode and the ion inlet device forms an electrolytic capacitor; and/or (b) holding said ion inlet device at a relatively high potential, and holding said fluid sample or electrode at a relatively low or ground potential, such that the volume between the fluid sample or electrode and the ion inlet device forms an electrolytic capacitor.

12. A method of mass spectrometry as claimed in claim 11, further comprising switching or repeatedly switching between (a) and (b).

13. A method of mass spectrometry as claimed in claim 11, wherein said fluid sample forms the electrolyte in said electrolytic capacitor.

14. A method of mass spectrometry as claimed in claim 10, further comprising maintaining a constant potential difference between said fluid sample and said ion inlet device.

15. A method of mass spectrometry as claimed in claim 9, wherein said electrode forms part of a sample holder for holding said fluid sample.

16. An ion source comprising:

a sample holder and an acoustic transducer, wherein said sample holder is for containing a fluid sample, and said acoustic transducer is arranged and adapted to apply one or more pulses of acoustic energy to said fluid sample to cause a spray of said fluid sample to eject from a surface of said fluid sample; and a control system arranged and adapted to apply an AC, RF or alternating voltage to said fluid sample using an electrode.

17. A method of ionizing a sample, comprising:

providing a fluid sample, wherein said fluid sample is contained within a sample holder and comprises an analyte;

providing an acoustic transducer for applying acoustic energy to said fluid sample;

providing a first electrode located between said fluid sample or sample holder and said acoustic transducer, and a second electrode located above the sample holder;

maintaining a potential difference between said first electrode and said second electrode such that the volume between said first electrode and said second electrode forms an electrolytic capacitor, and fluid sample contained in the sample holder forms the electrolyte of said electrolytic capacitor; and applying one or more pulses of acoustic energy to said fluid sample using said acoustic transducer to cause a drop, stream or spray of the fluid sample to eject from the surface of said fluid sample.

18. An ion inlet device comprising:

a sample holder and an acoustic transducer, wherein said sample holder is for containing a fluid sample, and said acoustic transducer is arranged and adapted to apply one or more pulses of acoustic energy to said fluid sample to cause a drop, stream or spray of the fluid sample to eject from the surface of said fluid sample;

a first electrode located between said fluid sample or said sample holder and said acoustic transducer;

a second electrode located above the sample holder; and a control system arranged and adapted:

to maintain a potential difference between the first and second electrodes such that the volume between the first electrode and the second electrode forms an electrolytic capacitor, and fluid sample contained in the sample holder forms, in use, the electrolyte of the electrolytic capacitor.

19. An ion inlet device as claimed in claim 18, wherein said first electrode is built into or forms part of the sample holder.

20. An ion inlet device as claimed in claim 18, wherein said first electrode is separate from the sample holder.

* * * * *